US010435990B1

(12) United States Patent
Carter

(10) Patent No.: US 10,435,990 B1
(45) Date of Patent: Oct. 8, 2019

(54) METHOD AND APPARATUS FOR CLEANING A BLOWOUT PREVENTER STACK APPARATUS

(71) Applicant: TRI-STATE ENVIRONMENTAL, LLC, Houma, LA (US)

(72) Inventor: Anthony Scott Carter, Petal, MS (US)

(73) Assignee: TRI-STATE ENVIRONMENTAL, LLC, Houma, LA (US)

( * ) Notice: Subject to any disclaimer, the term of this patent is extended or adjusted under 35 U.S.C. 154(b) by 513 days.

(21) Appl. No.: 15/162,467

(22) Filed: May 23, 2016

Related U.S. Application Data

(60) Provisional application No. 62/329,336, filed on Apr. 29, 2016, provisional application No. 62/164,991, filed on May 21, 2015.

(51) Int. Cl.

| | |
|---|---|
| ***E21B 41/00*** | (2006.01) |
| ***B08B 9/032*** | (2006.01) |
| ***E21B 33/06*** | (2006.01) |

(52) U.S. Cl.
CPC ..... *E21B 41/00* (2013.01); *B08B 9/032* (2013.01); *E21B 33/06* (2013.01)

(58) Field of Classification Search
CPC ..... E21B 41/00; E21B 33/06; B08B 9/032; B08B 9/04; B08B 9/0535; B08B 9/0433
See application file for complete search history.

(56) References Cited

U.S. PATENT DOCUMENTS

| | | | | |
|---|---|---|---|---|
| 1,704,364 | A | 3/1929 | Markley | |
| 4,518,041 | A | 5/1985 | Zublin | |
| 6,684,706 | B2 | 2/2004 | Knight et al. | |
| 7,040,331 | B2 * | 5/2006 | Garman | B08B 9/0433 134/167 C |
| 7,231,968 | B2 | 6/2007 | Owens | |
| 8,381,816 | B2 | 2/2013 | Leduc et al. | |
| 10,174,564 | B1 * | 1/2019 | Carter | E21B 17/006 |
| 2004/0050553 | A1 | 3/2004 | Edvardsen et al. | |

* cited by examiner

*Primary Examiner* — Douglas Lee
(74) *Attorney, Agent, or Firm* — Garvey, Smith & Nehrbass, Patent Attorneys, L.L.C.; Mackenzie D. Rodriguez; Charles C. Garvey, Jr.

(57) ABSTRACT

A method of cleaning a blow-out preventer stack that is preferably attached to an oil and gas well drilling platform including an initial disconnecting of the stack from the well so that it can be lifted. The stack is then preferably lifted vertically a selected distance. The method further includes lowering a water pressure cleaning tool into the stack bore using a hose, the tool preferably being attached to a lower end portion of the hose. Pressurized cleaning fluid is transmitted to the cleaning tool via the hose. A collection vessel is preferably placed below the stack and spaced from the stack so that cleaning fluid and cleaned debris exit the stack bore or interior and enter the vessel during cleaning. The method includes continuously discharging the fluid and debris from the vessel via a discharge outlet of the vessel.

20 Claims, 12 Drawing Sheets

METHOD AND APPARATUS FOR CLEANING A BLOWOUT PREVENTER STACK APPARATUS

CROSS-REFERENCE TO RELATED APPLICATIONS

This application claims the benefit of U.S. Provisional Patent Application Ser. No. 62/164,991, filed 21 May 2015; and, U.S. Provisional Patent Application Ser. No. 62/329,336, filed 29 Apr. 2016, both of which are incorporated herein by reference. Priority of U.S. Provisional Patent Application Ser. No. 62/164,991, filed 21 May 2015; and, U.S. Provisional Patent Application Ser. No. 62/329,336, filed 29 Apr. 2016 is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to blowout preventers used in combination with oil and gas well drilling operations. More particularly, the present invention relates to a method and apparatus for cleaning the bore or interior of a blowout preventer.

2. General Background of the Invention

Blowout preventers are commonly used on an oil and gas well drilling apparatus as a safety apparatus to control or prevent a well blowout situation. These oil and gas well blowout preventers can become clogged with chemicals, caked on drilling mud and other material.

One of the problems with the cleaning of a blowout preventer is that to disable the blowout preventer is also to disable or cease operation of the drilling rig or platform. These drilling rigs and platforms are expensive to operate, costing many thousands of dollars per hour. It is a problem that such a blowout preventer not only be cleaned, but be cleaned in a very short period of time so that the drilling rig or platform can be returned to oil and gas well drilling operations.

The way in which blowout preventer stacks have been cleaned in the prior art is that each component that the stack is comprised of has to be detached/disassembled from one another. Before the disassembling process takes place, berms or other temporary fluid containment systems have to be setup. Once the disassembled sections of the stack are in place within the berms, workers then have to pressure-wash each component.

Once the cleaning is completed, the stack has to be reassembled and the berms and cleaning equipment have to be rigged down/put away.

This operation ("the old way") takes place on the deck, shutting down most other procedures. This operation takes approximately between 6-10 hours. The present invention saves the time it takes to disassemble the stack's components and set up the berms. Operation lasts approximately two hours with the method and apparatus of the present invention.

BRIEF SUMMARY OF THE INVENTION

The present invention is directed to a method of cleaning a blow out preventer stack that is attached to an oil and gas well drilling platform and wellhead.

The method begins with a disconnecting of the stack from the wellhead so that it can be lifted.

Using a crane or other lifting device, the stack is preferably lifted vertically a selected distance. The stack has an interior or internal bore that is to be cleaned. For cleaning, the stack can be generally vertically oriented, thus vertically orienting the bore or interior. A support (e.g. tripod) is preferably positioned upon an upper end portion of the stack, such as on a riser adapter or flex joint.

A roller bearing is preferably attached to the support. The roller bearing supports a hose so that one portion of the hose drops vertically from the roller bearing into the stack bore or stack interior and a second portion of the hose extends laterally from the roller bearing. One end portion of the hose has a pressure washing and cleaning tool. Such tools are commercially available. The hose preferably travels upon the roller bearing such as when an operator lowers the cleaning tool into the bore or the stack or elevates the cleaning tool during retrieval. The water pressure cleaning tool is preferably lowered into the stack bore using the hose, roller bearing and a feed device. The cleaning tool is preferably attached to a lower end portion of the hose.

A pressurized cleaning fluid can be transmitted to the cleaning tool via the hose. Pressure in the hose can be between about 10,000 and 15,000 p.s.i.

A collection vessel is preferably placed below the stack and spaced from the stack so that cleaning fluid and debris exit the stack interior or bore via gravity and enter the vessel during cleaning.

Cleaning fluid and any removal debris are continuously discharged from the vessel via a discharge outlet of the vessel, suction hose and pump.

In one embodiment, the vessel is preferably placed at an elevation that is below the stack to be cleaned and above the wellhead.

In one embodiment, the hose travel is preferably controlled with a foot control that engages the hose.

In one embodiment, the support preferably rests upon a stack riser adapter. The support can be a tripod.

In one embodiment, a suction hose with pump is preferably connected to the discharge outlet.

In one embodiment, a feed unit preferably grips the hose and controls feed of the hose.

In one embodiment, the feed unit preferably controls feed of the hose including forward and reverse directions.

In one embodiment, a foot control preferably enables an operator to control the feed unit and hose travel using his or her foot.

After cleaning is completed, the blow out preventer stack is lowered and reconnected to the wellhead.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
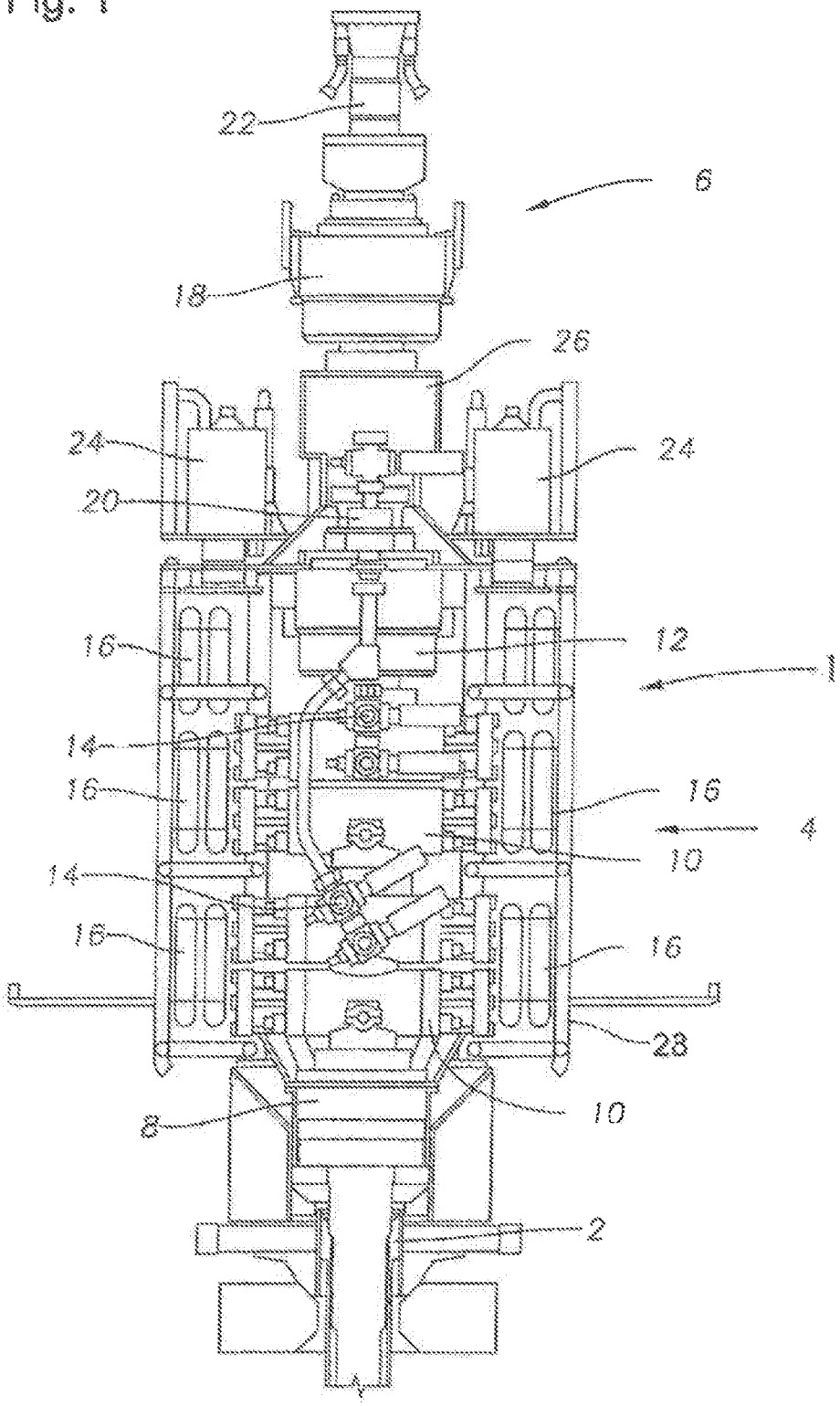
FIG. 1 is a prior art blowout preventer stack.

FIG. 1 shows a prior art blowout preventer stack 1 attached to wellhead 2. Such blowout preventer stacks are known and commercially available. An example of a blowout preventer stack 1 can be seen in U.S. Pat. No. 7,300,033 which is incorporated herein by reference. An interface between the blowout preventer stack 1 and the wellhead 2 can be wellhead connector 8. Components of the blowout preventer stack 1 can include lower stack assembly 4, upper stack assembly 6, ram blowout preventers 10, annular blowout preventers 12, 18, choke and kill valves 14, hydraulic accumulators 16 and choke and kill connectors 20.

At the upper end portion of the blowout preventer stack 1 there is a riser adapter 22. Below the riser adapter 22 and annular blowout preventer 18 are collet connector 26, control pods 24 and frame 28. The present invention is directed to a method and apparatus 30 for cleaning the blowout preventer stack 1.

Figure 2:
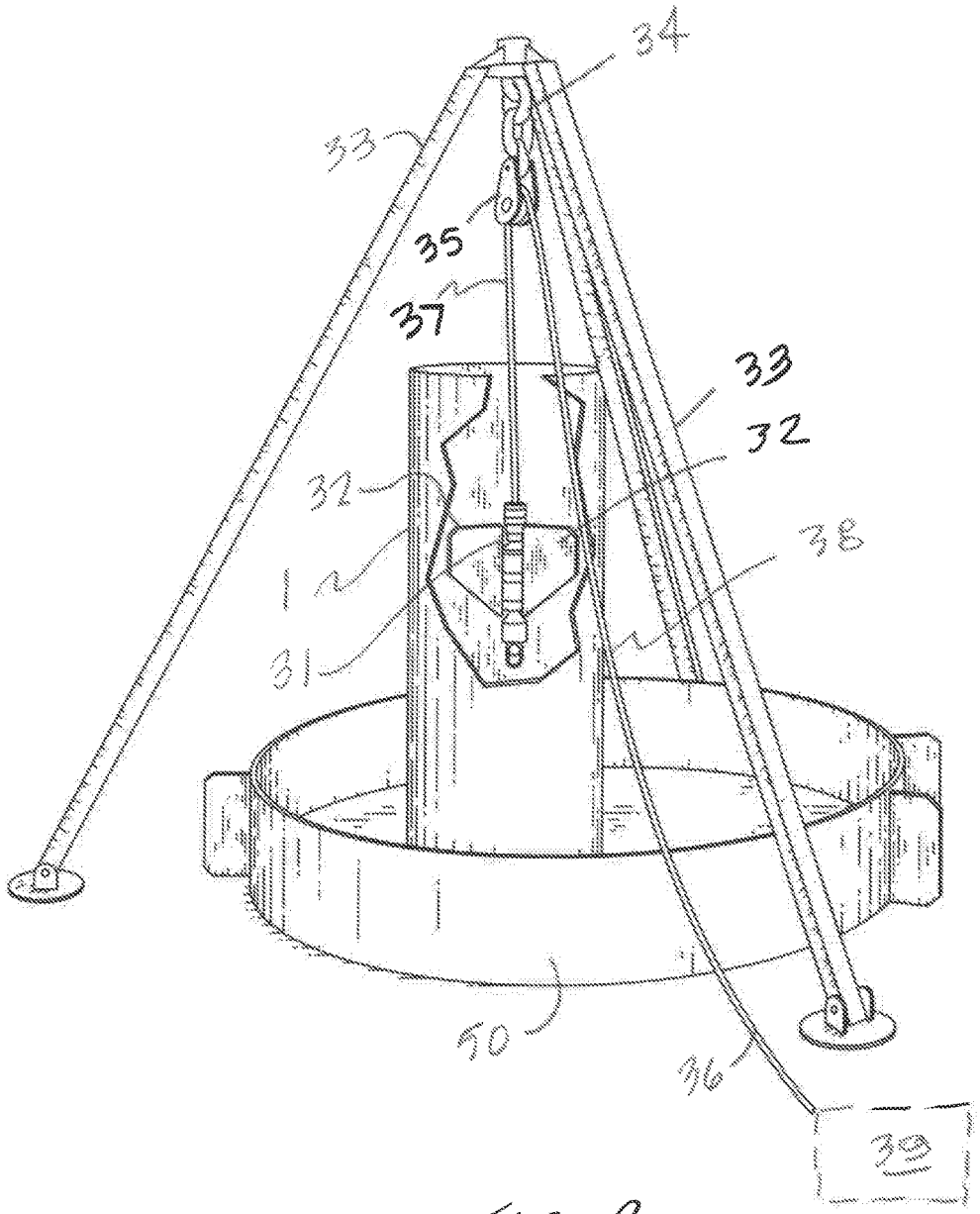
FIG. 2 is a partial perspective view of a preferred embodiment of the apparatus of the present invention and illustrating part of the method of the present invention.
Figure 3:
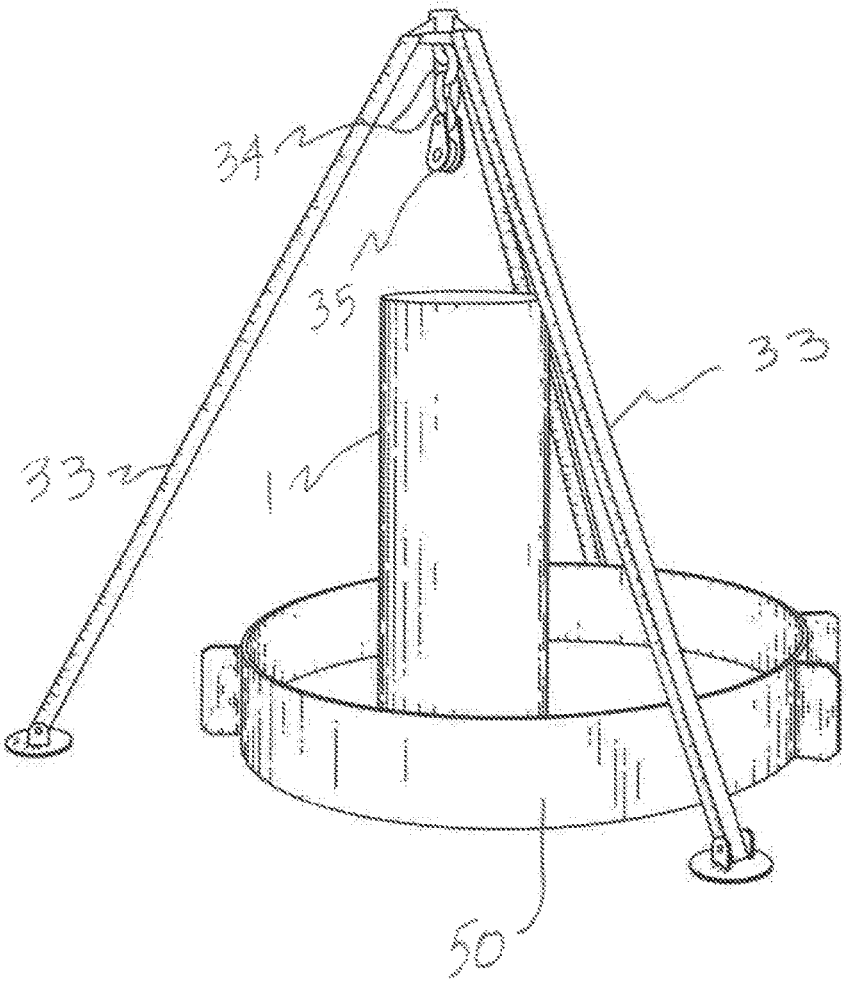
FIG. 3 is a partial perspective view of a preferred embodiment of the apparatus of the present invention and illustrating part of the method of the present invention.
Figure 4:
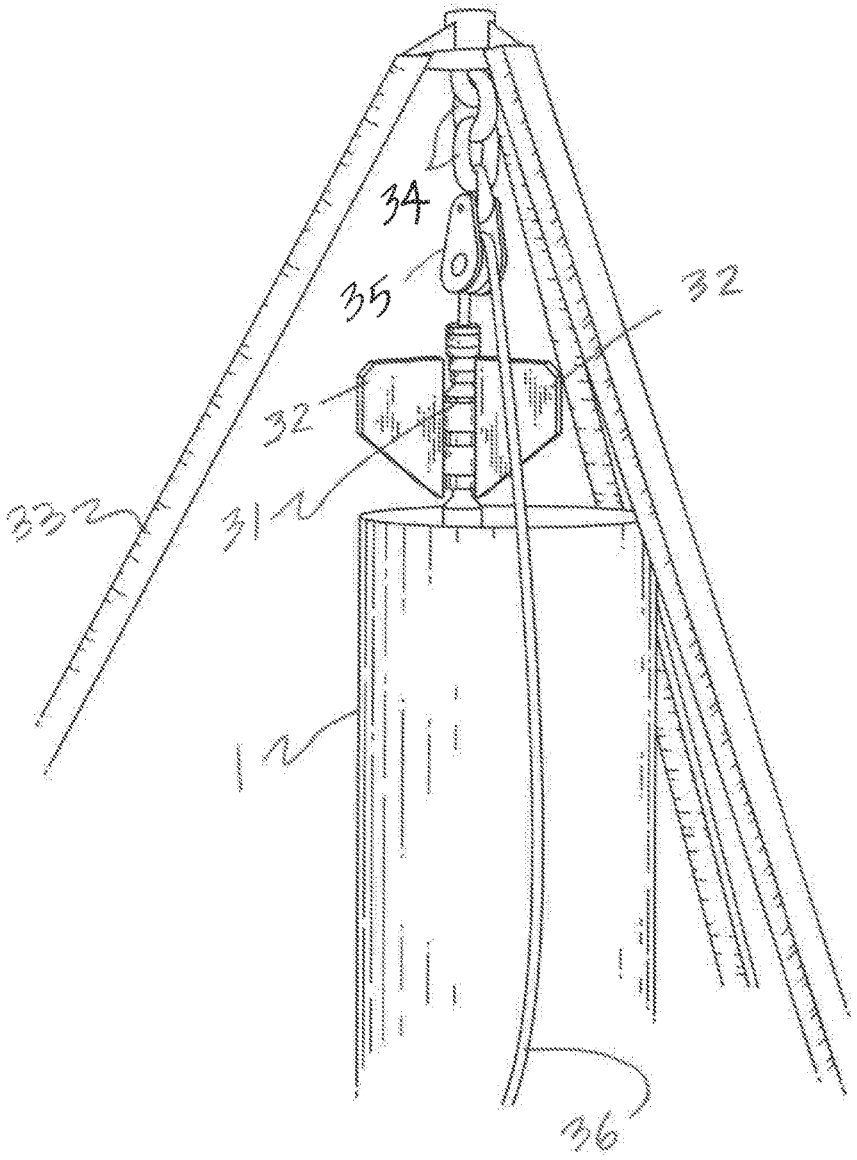
FIG. 4 is a partial perspective view of a preferred embodiment of the apparatus of the present invention and illustrating part of the method of the present invention.
Figure 5:
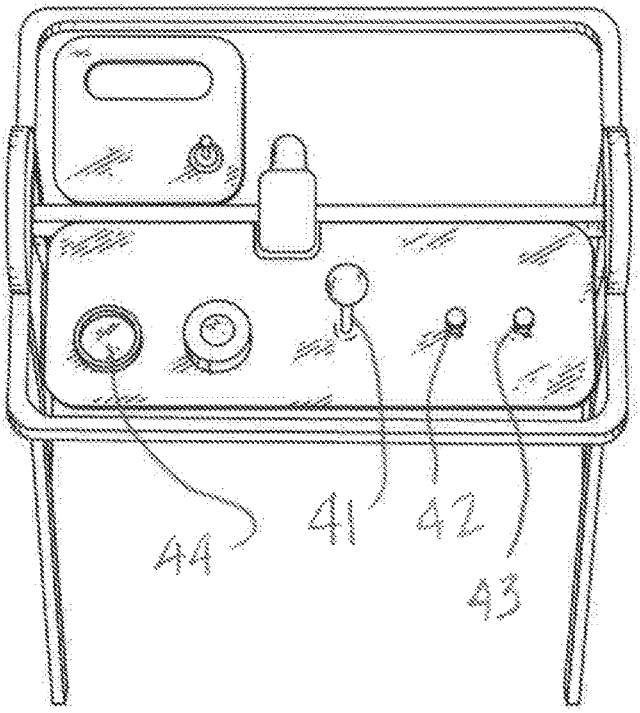
FIG. 5 is a partial perspective view of a preferred embodiment of the control panel of the present invention.
Figure 6:
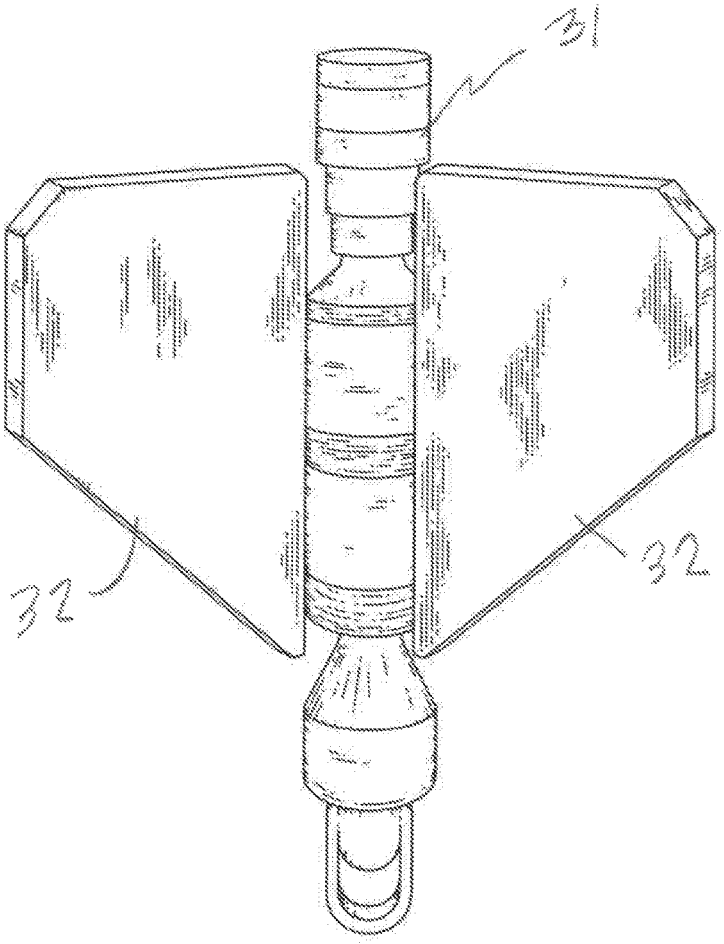
FIG. 6 is a partial perspective view of a preferred embodiment of the cleaning tool of the present invention.
Figure 7:
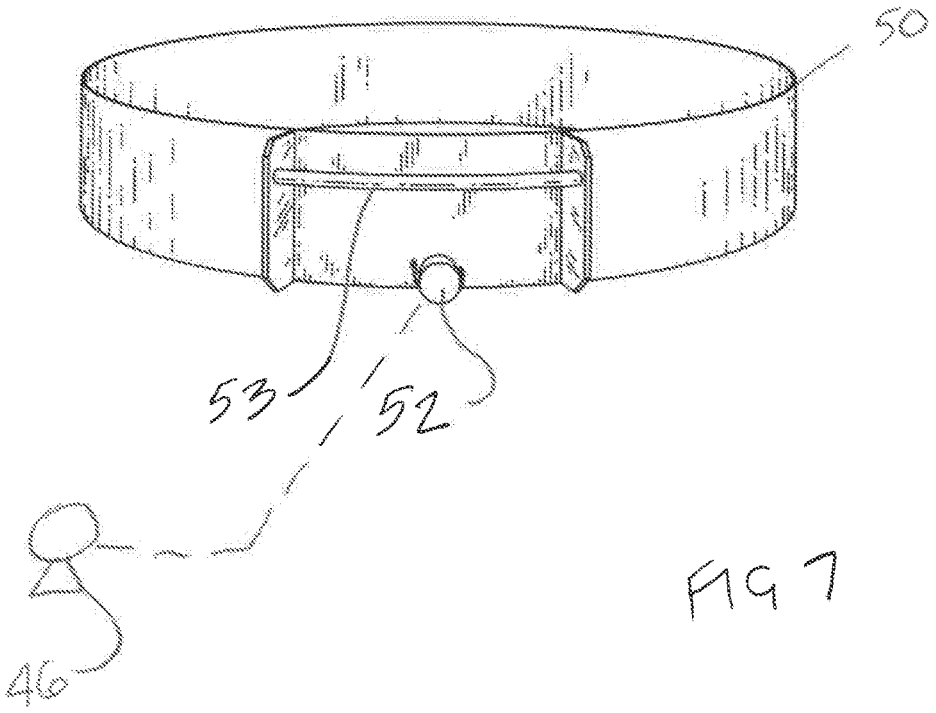
FIG. 7 is a partial perspective view of a preferred embodiment of the drain or catch pan of the present invention.
Figure 8:
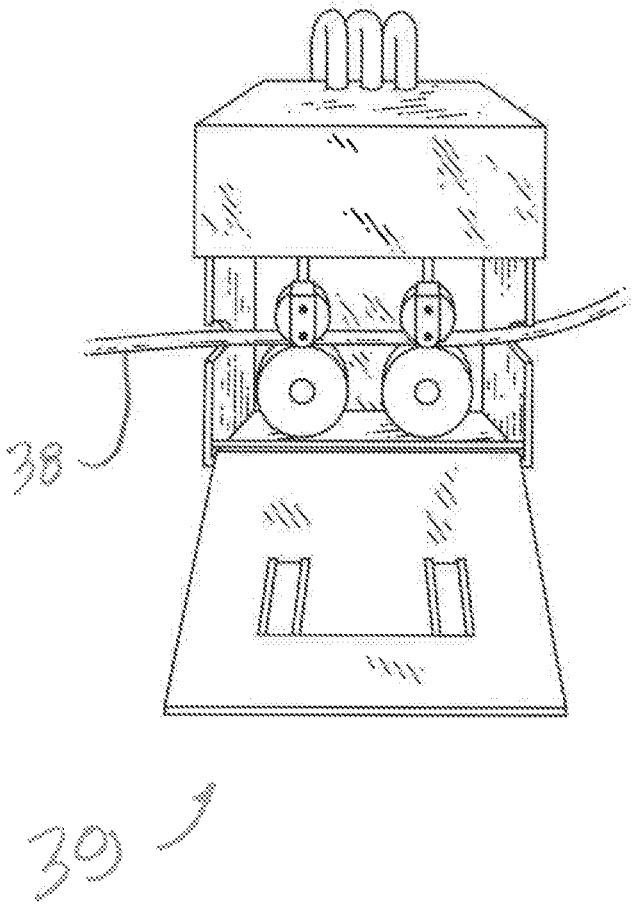
FIG. 8 is a partial perspective view of a preferred embodiment of the spool feeder of the present invention.
Figure 9:
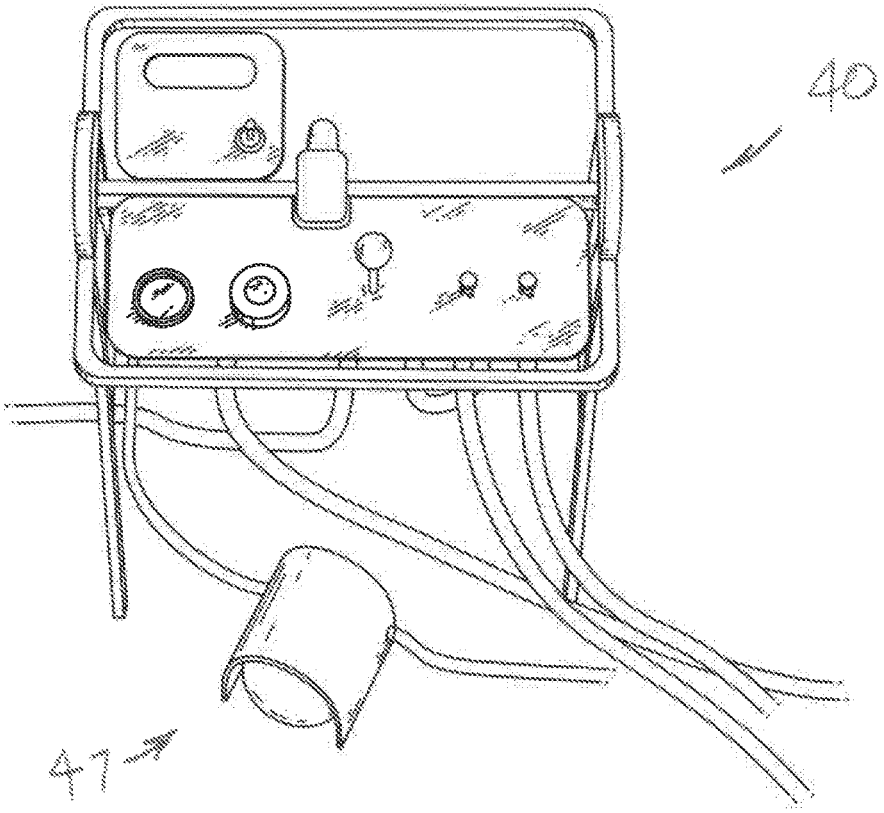
FIG. 9 is a partial perspective view of another preferred embodiment of the control panel of the present invention.

The method and apparatus of the present invention enable quick and efficient cleaning of the blowout preventer stack 1 on the drilling platform, even in remote locations such as an offshore marine location. The apparatus of the present invention 30 employs a pressure washing tool 31 that can be equipped within centralizer fins 32 (e.g., three (3) circumferentially spaced apart fins 32). As part of the method of the present invention, the blowout preventer stack 1 is disconnected from the wellhead 2. The blowout preventer stack 1 is then preferably lifted vertically using a crane or other lifting device. Once so disconnected from wellhead 2 and elevated, collection vessel or catch pan 50 is provided to catch cleaning fluid that is emitted to the interior or bore of the blow out preventer stack during the cleaning. Catch pan or vessel 50 can be placed under the now elevated blowout preventer stack 1. It should be understood that the blow out preventer stack 1 of FIG. 1 is schematically shown in FIGS. 2-4 as a hollow tube or cylinder shape for purposes of clarity and simplicity. In use, tool 31 would be lowered into the bore or interior of a blow out preventer 1 as seen in FIG. 1 and wherein all rams, shut offs, valves would be opened to enable internal cleaning. When so elevated by a crane or other lifting device, the bore or interior of stack 1 is open ended.

A support device such as a tripod 33 is then placed on the top of the blowout preventer stack 1 such as for example on the riser adapter or flex joint 22 or on the annular blow out preventer 18 of FIG. 1. The tripod 33 supports a pulley or sheave 35 preferably using one or more shackles 34 or other suitable connectors or rigging. A fluid carrying hose 36 is designed to carry cleaning fluid under substantial pressure, such as between about 10,000 and 15,000 p.s.i. The cleaning fluid can be water or a combination of water and a soap or detergent. The fluid carrying hose 36 is preferably rigged to the pulley, roller or sheave 35 so that a vertical section 37 is available to hold the pressure washing tool 31 and lower it into the bore or interior of the blowout preventer stack 1 so that the tool 31 can clean the bore or interior of stack 1.

The hose 36 preferably includes a laterally extending or inclined section 38 which connects to a hose feeder 39. The hose feeder 39 is preferably controlled with a control panel 40. Hose feeder 39 can be a commercially available unit such as a Stone Age Autobox Model ABX-500. Hose feeder 39 and high pressure pump (or pumps) supplying high pressure cleaning fluid to tool 31 can be controlled with control panel 40. The control panel 40 can employ lever 41 and speed controls 42, 43 as well as hose clamp pressure gauge 44. The control panel 40 can be provided with a high pressure switch 45. Lever 41 is a device for controlling (e.g., pneumatically) the clamp wheels of the hose feed 39 and direction forward or reverse. The objective is for the hose clamp wheels to control direction of high-pressure hose to clean in and out of a bore in an automated fashion.

The speed control 42 is a device for controlling (e.g., pneumatically) the hose clamp wheels in the hose feed 39, speed or rate of revolutions in one direction forward. The hose clamp wheels in turn force the hose forward.

The speed control 43 is a device for controlling (e.g., pneumatically) the hose clamp wheels of the hose feed unit 39, speed or rate of revolutions in one direction reverse. The hose clamp wheels in turn force the hose relationally reverse.

The hose clamp pressure gauge 44 shows the pressure, measured in psi, that the hose clamp wheels are gripping the high-pressure hose.

High pressure switch 45 is used to actuate the hose clamp wheels and regulate their ability to clamp down on the high pressure hose.

Fluid carrying hose 36 can be connected to a foot control 47 pedal associated with feeder 39 which enables an operator to feed hose to the pulley or sheave 35, thus lowering the pressure washing tool 31 into the bore of the blow out preventer 1. Alternatively, the foot control 47 can be used to elevate the pressure washing tool 31 relative to the pulley or sheave 35.

One or more pressure washer units 48, 49 (not shown) (including high pressure pumps) can be employed to supply fluid under pressure for the purposes of washing and cleaning the internals of the blowout preventer stack 1. Units 48, 49 can include a pressure washer that is supplied with heated water such as washer 48 or a pressure washer 49 that is not heated. Pressure generated by washer 48 can be for example, between about 10,000 and 15,000 p.s.i. with an exemplary temperature range of between about 70 and 170° F. for the cleaning fluid, more particularly between about 70 and 120° F.

The vessel or catch pan 50 preferably provides a drain outlet 52. The drain outlet 52 can be connected to a hose and a suction device such as a pump 46. The vessel or pan 50, outlet suction line (connected to outlet 52) and pump 46 (connected to the suction line) preferably enable continuous removal and transmission to a suitable disposal tank of spent cleaning fluid and any removed debris, dirt, sludge or other containment. The vessel or catch pan 50 can be provided with one or more handles 53.

After the interior (or bore) of the blowout preventer stack 1 has been cleaned, the supporting crane then lowers the blowout preventer stack 1 back into position upon the wellhead 2. Oil and gas well drilling operations can be resumed immediately after cleaning is completed. Such cleaning can be accomplished in less than an hour, such as between about 30 and 60 minutes, saving expensive rig operating time compared to a removal of the blowout preventer and shipment to a land based cleaning facility.

Figure 10:
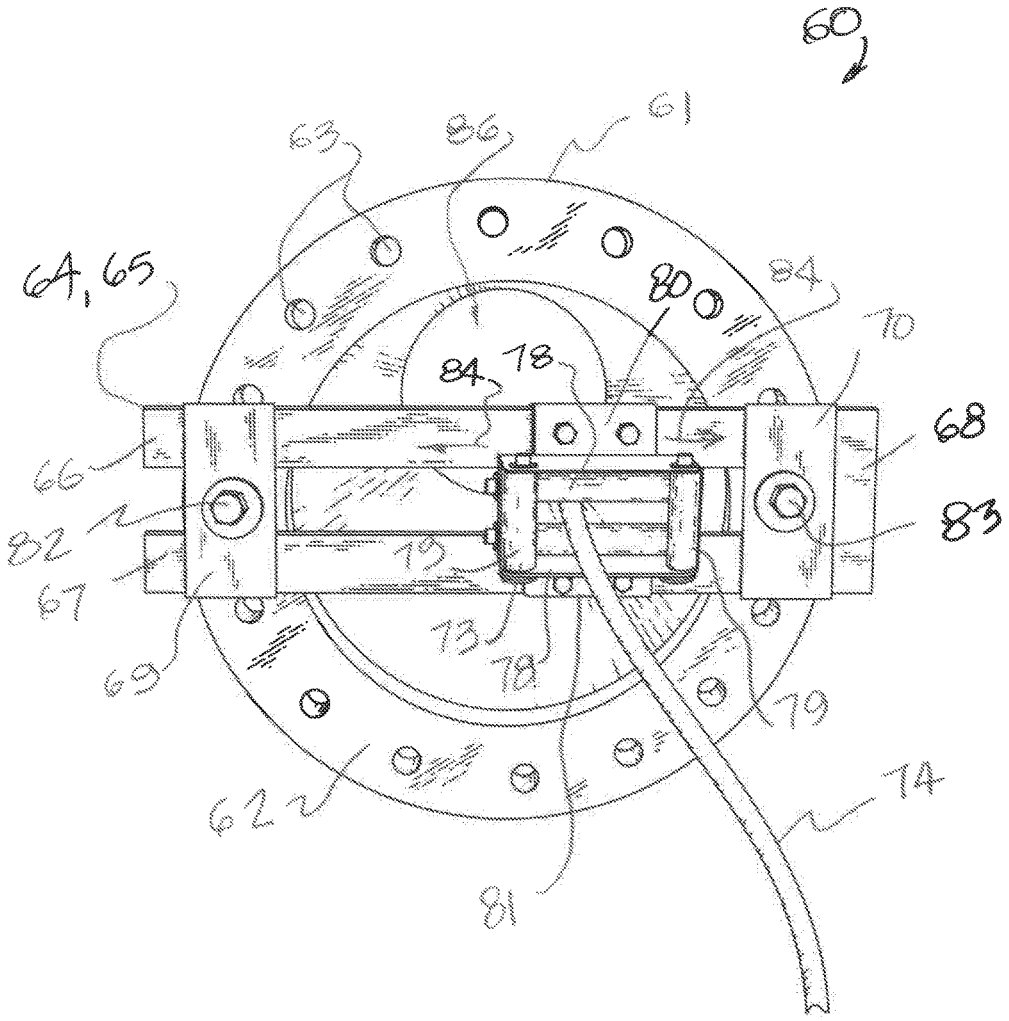
FIG. 10 is a partial perspective view of a preferred embodiment of the apparatus of the present invention and illustrating part of the method of the present invention.
Figure 11:
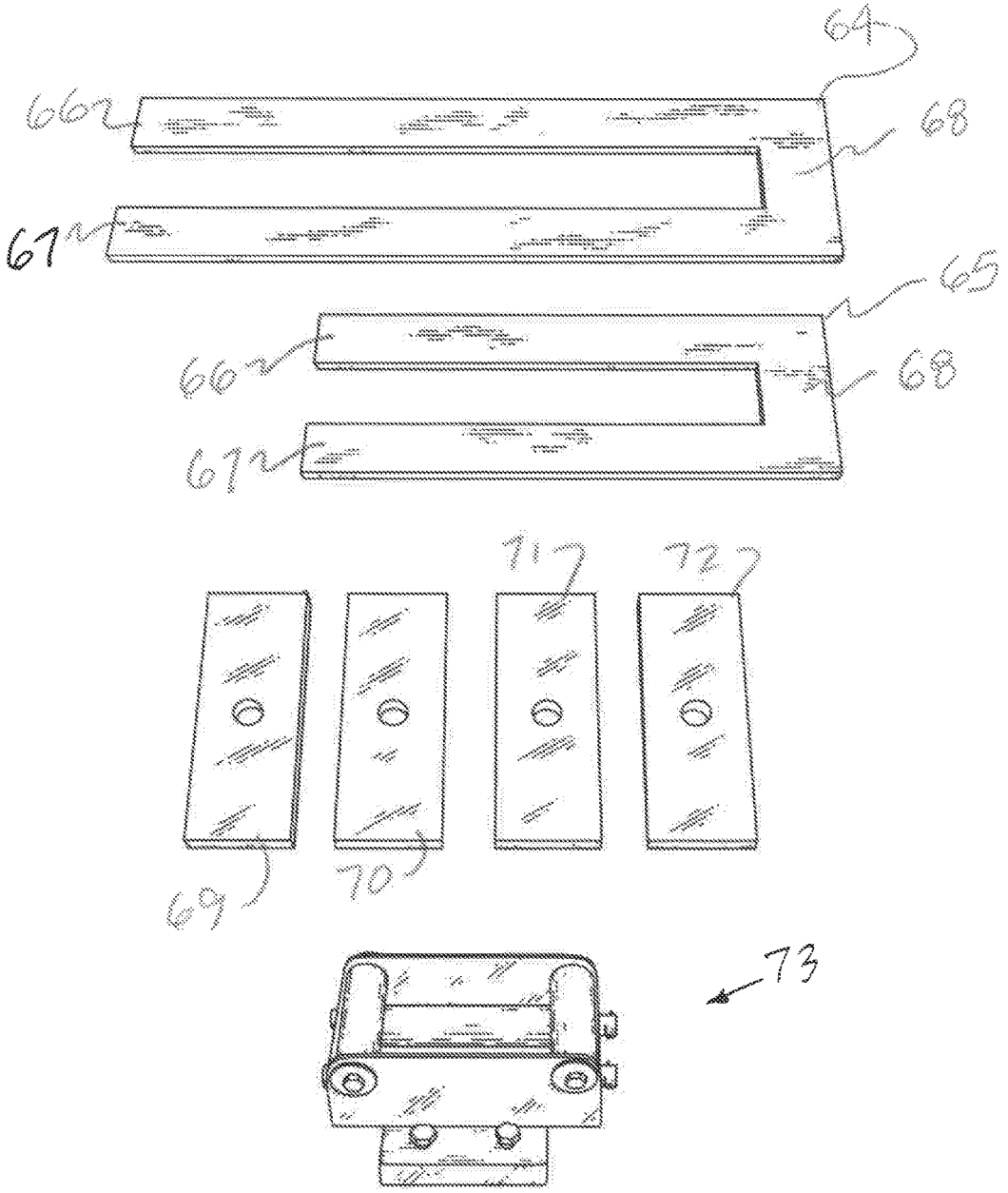
FIG. 11 is an exploded view illustrating components of the back out preventer of FIG. 10.
Figure 12:
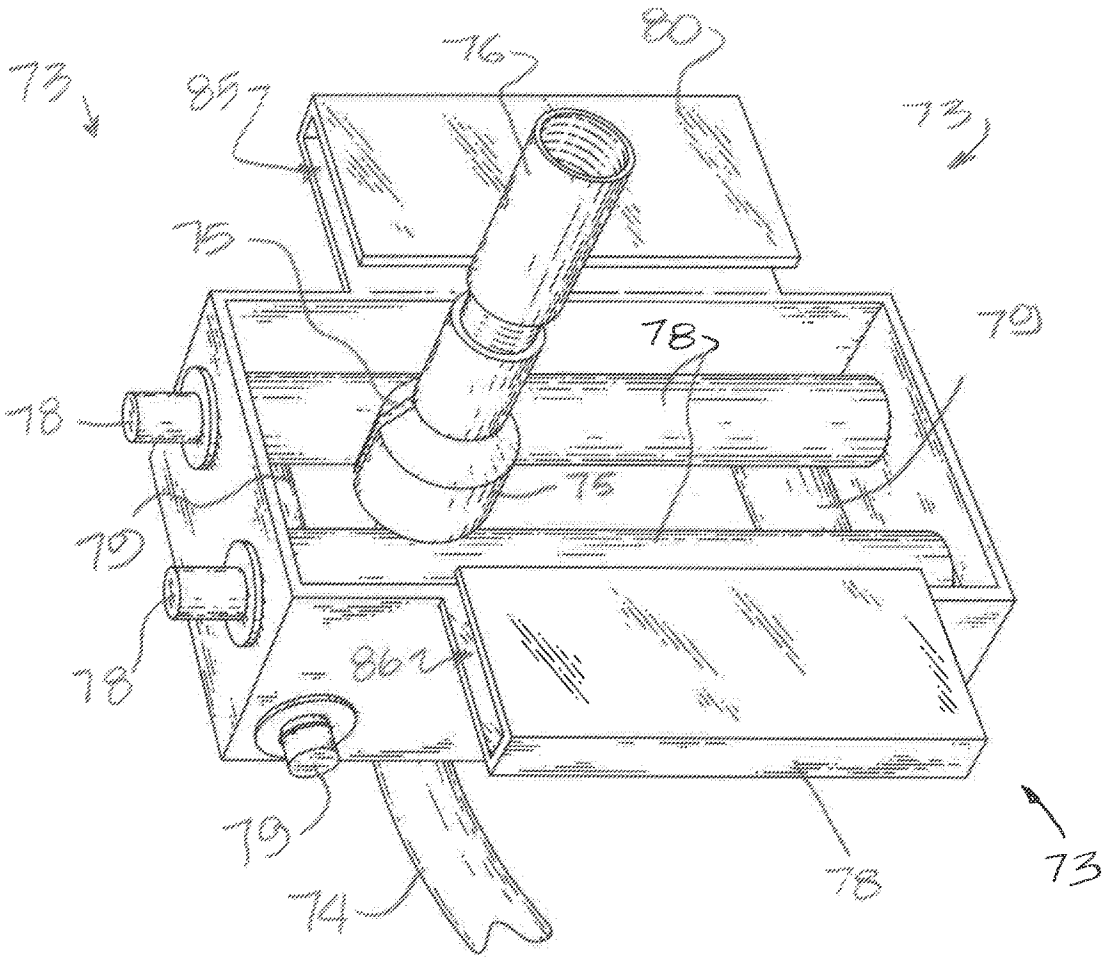
FIG. 12 is an exploded view illustrating components of the back out preventer of FIG. 10.

In one embodiment, a back up preventer or hose and pressure washing tool retainer 60 can be seen in FIGS. 10-12. The preventer or retainer 60 attaches to a blow out preventer 1 having an attached annular flange or to a pipe 61 or other adapter having an annular flange 62. Flange 62 can be a weld neck type annular flange having a plurality of bolt circle openings 63, each receptive of a bolted connection (not shown) that enables the pipe or riser 61 and flange 62 to be connected to another pipe/riser and flange 62 or other pipe spool or other equipment. The apparatus 60 can be used in concert with the cleaning of a blow out preventer 1, connected to an annular flange 62 that is part of or connected to the blow out preventer 1.

In FIG. 10, bolted connections at 82, 83 hold a selected plate 69 or 70 to annular flange 62 wherein each bolted connection 82, 83 includes a bolt that extends through a bolt circle opening 63 and connects with a nut. A washer can also be a part of bolted connection 82 or 83.

Bolted connections 82, 83 and fastener plates 69, 70, 71, 72 hold and support a mounting plate 64 or 65, each having longer flanges or plates 66, 67 connected with a shorter flange or plate 68.

Roller assembly 73 is mounted to a selected mount or plate 64 or 65 so that it can travel laterally as indicated by arrows 84 in FIG. 10. Roller assembly 73 includes roller frame 77 having upper and lower guides 80, 81. Each guide has a slot 85, 86 that is receptive of a larger flange or plate 66 or 67. Upper guide 80 has slot 85 that receives flange 66. Lower guide 81 has a slot 86 that receives flange 67.

Roller frame 77 has a pair of horizontal rollers 78 and a pair of vertical rollers 79. High pressure hose or lance line 74 is connected to a cleaning tool 31 that emits a high velocity, high pressure fluid stream (or streams) for cleaning the inside of pipe 61 or blow out preventer 1. Enlarged nut/enlarged annular fitting 75 (also known as "hose stop") is a "stop" attached to hose 74 next to coupling 76. Coupling 76 enables attachment to the cleaning tool (e.g., 31) that receives pressurized fluid from hose 74 and a high pressure pump. The nut or fitting 75 is too large to fit through the opening that is between a pair of horizontal rollers 78 or between a pair of vertical rollers 79 thus preventing escape of the cleaning tool 31, coupling 76 and hose 74 from the bore 87 of pipe 61.

The following is a list of parts and materials suitable for use in the present invention:

PARTS LIST:

| PART NUMBER | DESCRIPTION |
|---|---|
| 1 | blowout preventer stack |
| 2 | wellhead |
| 4 | lower stack assembly |
| 6 | upper stack assembly (lower marine riser package) |
| 8 | wellhead connector |
| 10 | ram blowout preventers |
| 12 | annular blowout preventer |
| 14 | choke and kill valves |
| 16 | hydraulic accumulators |
| 18 | annular blowout preventer |
| 20 | choke and kill connectors |
| 22 | riser adapter (flex joint) |
| 24 | control pods |
| 26 | collet connector |
| 28 | frame |
| 30 | cleaning apparatus |
| 31 | pressure washing tool |
| 32 | centralizer fin |
| 33 | tripod |
| 34 | shackle |
| 35 | pulley/sheave/roller |
| 36 | fluid carrying hose |
| 37 | vertical section |
| 38 | laterally extending section |
| 39 | hose feeder |
| 40 | control panel |
| 41 | lever |
| 42 | speed control (FWD) |
| 43 | speed control (REV) |
| 44 | hose clamp pressure gauge |
| 45 | high pressure switch |
| 46 | pump |
| 47 | foot control |
| 48 | pressure washer (hot)(not shown) |
| 49 | pressure washer (hydroblaster)(not shown) |
| 50 | vessel/catch pan/collection vessel |
| 52 | drain outlet |
| 53 | handle |
| 60 | back out preventer/hose and pressure washing tool retainer |
| 61 | pipe/riser |
| 62 | annular flange |
| 63 | bolt circle opening |
| 64 | mount/plate |
| 65 | mount/plate |
| 66 | longer flange/plate |
| 67 | longer flange/plate |
| 68 | shorter flange/plate |
| 69 | fastener plate |
| 70 | fastener plate |
| 71 | fastener plate |
| 72 | fastener plate |
| 73 | roller assembly |
| 74 | high pressure lance line/high pressure hose |
| 75 | enlarged nut/fitting/annular stop member ("hose stop") |
| 76 | coupling |
| 77 | roller frame |
| 78 | horizontal roller |
| 79 | vertical roller |
| 80 | upper guide |
| 81 | lower guide |
| 82 | bolted connection |
| 83 | bolted connection |
| 84 | arrows |
| 85 | slot |
| 86 | slot |
| 87 | bore |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A method of cleaning a blow out preventer having an attached annular pipe flange, comprising the steps of:

a) attaching to the pipe flange a support that attaches to the pipe flange at first and second spaced apart positions, the support having an upper rail and a lower rail;

b) placing a roller frame on the support, the roller frame including multiple rollers surrounding a hose opening;

c) wherein the roller frame of step "b" has upper and lower guides and one or more rollers;

d) enabling the roller frame to travel laterally upon the rails by engaging the upper rail with the upper guide and the lower rail with the lower guide;

e) placing a cleaning tool in the blow out preventer and a hose that extends through the hose opening and to the cleaning tool and cleaning the blow out preventer with the cleaning tool;

(f) preventing travel of the cleaning tool through the hose opening during cleaning of step "e" in a direction that would remove a section of the hose from the blow out preventer;

g) wherein in step "f" the hose has an enlarged portion next to the cleaning tool that will not pass through the hose opening.

2. The method of claim 1 wherein the enlarged portion is a removable fitting and further comprising attaching the removable fitting to the hose next to the cleaning tool.

3. The method of claim 1 wherein the enlarged portion is a removable annular member and further comprising attaching the removable annular member to the hose next to the cleaning tool.

4. The method of claim 1 wherein in step "e" the cleaning tool is a fluid powered cleaning tool and the hose supplies pressured fluid to the cleaning tool.

5. The method of claim 1 wherein the roller frame is fitted with multiple of said rollers, including one or more vertically placed rollers and one or more horizontally placed rollers.

6. The method of claim 1 wherein in step "g" the enlarged portion has a generally conically shaped outer surface portion.

7. The method of claim 6 further comprising the step of positioning the generally conically shaped outer surface portion to engage the rollers when the hose has a section removed from the blow out preventer.

8. The method of claim 6 further comprising the step of positioning the generally conically shaped outer surface portion to engage the rollers when the hose attempts to back out of the blow out preventer during cleaning.

9. The method of claim 1 wherein the pipe flange has a plurality of circumferentially spaced bolt circle openings and it step "a" the support attaches to one or more of said bolt circle.

10. A method of cleaning a flanged pipe having a pipe section, an annular pipe flange attached to the pipe section and an open ended bore that is to be cleaned, comprising the steps of:

a) attaching to the pipe flange a support that attaches to the pipe flange at first and second spaced apart positions, the support having one or more rails;

b) placing a roller frame on the support, the roller frame including a hose opening;

c) wherein the roller frame of step "b" has one or more guides and one or more rollers, the one or more rollers next to the hose opening;

d) supporting the roller frame upon the support by engaging the one or more rails with the one or more guides;

e) placing a cleaning tool in the bore and a hose that extends through the hose opening and to the cleaning tool and cleaning the bore with the cleaning tool;

f) preventing travel of the cleaning tool through the hose opening during cleaning of step "e" in a direction that would remove a section of the hose from the bore;

g) wherein in step "f" the hose has an enlarged portion next to the cleaning tool that will not pass through the hose opening.

11. A method of cleaning a blow out preventer having an internal bore and an attached annular pipe flange, comprising the steps of:

a) attaching a support to the pipe flange at first and second spaced apart positions, the support having an upper rail and a lower rail;

b) placing a roller frame on the support of step "a", the roller frame including multiple rollers surrounding a hose opening;

c) wherein the roller frame of step "b" has upper and lower guides and one or more rollers;

d) enabling the roller frame to travel laterally upon the rails by engaging the upper rail with the upper guide and the lower rail with the lower guide;

e) placing a cleaning tool in the blow out preventer internal bore and a hose that extends through the hose opening and to the cleaning tool;

f) cleaning the blow out preventer with the cleaning tool;

g) preventing travel of the cleaning tool through the hose opening during cleaning of step "f" in a direction that would remove a section of the hose from the internal bore; and h) wherein in step "g" the hose has an enlarged portion next to the cleaning tool that will not pass through the hose opening.

12. The method of claim 11 wherein the enlarged portion is a removable fitting and further comprising attaching the removable fitting to the hose next to the cleaning tool.

13. The method of claim 11 wherein the enlarged portion is a removable annular member and further comprising attaching the removable annular member to the hose next to the cleaning tool.

14. The method of claim 11 wherein in step "e" the cleaning tool is a fluid powered cleaning tool and the hose supplies pressured fluid to the cleaning tool.

15. The method of claim 11 wherein the roller frame is fitted with multiple of said rollers, including one or more vertically placed rollers and one or more horizontally placed rollers.

16. The method of claim 11 wherein in step "h" the enlarged portion has a generally conically shaped outer surface portion.

17. The method of claim 16 further comprising the step of positioning the generally conically shaped outer surface portion to engage the rollers when the hose has a section removed from the blow out preventer.

18. The method of claim 16 further comprising the step of positioning the generally conically shaped outer surface portion to engage the rollers when the hose attempts to back out of the bore during cleaning.

19. The method of claim 11 wherein the pipe flange has a plurality of circumferentially spaced bolt circle openings and it step "a" the support attaches to one or more of said bolt circle.

20. A method of cleaning a flanged pipe having a pipe section, an annular pipe flange attached to the pipe section and an open ended bore that is to be cleaned, comprising the steps of:

a) attaching a support to the pipe flange at first and second spaced apart positions, the support having one or more rails;

b) placing a roller frame on the support, the roller frame including a hose opening;

c) wherein the roller frame of step "b" has one or more guides and one or more rollers, the one or more rollers positioned next to the hose opening;

d) supporting the roller frame upon the support by engaging the one or more rails with the one or more guides;

e) placing a cleaning tool in the bore and a hose that extends through the hose opening and to the cleaning tool;

f) cleaning the bore with the cleaning tool;

g) preventing travel of the cleaning tool through the hose opening during cleaning of step "f" in a direction that would remove a section of the hose from the bore; and h) wherein in step "g" the hose has an enlarged portion next to the cleaning tool that will not pass through the hose opening.

* * * * *